US008832965B2

(12) United States Patent
Son et al.

(10) Patent No.: US 8,832,965 B2
(45) Date of Patent: Sep. 16, 2014

(54) LAUNDRY MACHINE AND CONTROLLING METHODS THEREOF

(75) Inventors: Young Bok Son, Changwon-si (KR); Myoung Suk You, Changwon-si (KR); Sung Min Ye, Changwon-si (KR); Tae Hee Lee, Changwon-si (KR); Deug Hee Lee, Changwon-si (KR); Ae Kyung Chae, Changwon-si (KR); Yoon Seob Eom, Changwon-si (KR)

(73) Assignee: LG Electronics Inc., Seoul (KR)

( * ) Notice: Subject to any disclaimer, the term of this patent is extended or adjusted under 35 U.S.C. 154(b) by 306 days.

(21) Appl. No.: 13/375,425

(22) PCT Filed: Jul. 1, 2010

(86) PCT No.: PCT/KR2010/004271

§ 371 (c)(1),
(2), (4) Date: Nov. 30, 2011

(87) PCT Pub. No.: WO2011/002236

PCT Pub. Date: Jan. 6, 2011

(65) Prior Publication Data

US 2012/0066928 A1 Mar. 22, 2012

(30) Foreign Application Priority Data

Jul. 1, 2009 (KR) ..... 10-2009-0059734
Oct. 1, 2009 (KR) ..... 10-2009-0093863
Oct. 1, 2009 (KR) ..... 10-2009-0093864

(51) Int. Cl.
*F26B 7/00* (2006.01)
*D06F 33/02* (2006.01)

(52) U.S. Cl.
CPC ..... *D06F 33/02* (2013.01)
USPC ..... 34/413; 34/427; 34/467; 34/497; 8/137; 8/159; 68/12.24; 70/277

(58) Field of Classification Search
USPC ..... 34/380, 381, 413, 427, 467, 497; 8/137, 8/149, 159; 68/5 C, 5 R, 12.24, 19, 20; 70/91, 263, 277
See application file for complete search history.

(56) References Cited

U.S. PATENT DOCUMENTS 1,786,191 A * 12/1930 Carroll ..... 34/485
2,570,437 A * 10/1951 Ellis ..... 34/547

(Continued)

FOREIGN PATENT DOCUMENTS

JP 2005-131115 A 5/2005
JP 2009-106770 A 5/2009

(Continued)

*Primary Examiner* — Steve M Gravini
(74) *Attorney, Agent, or Firm* — Birch, Stewart, Kolasch & Birch, LLP

(57) ABSTRACT

One of the controlling methods disclosed relates to control of a laundry machine including a tub and a drum, the method includes the steps of: sensing selection of a tub drying step and performing the tub drying step. The other controlling method of a laundry machine comprises the steps of: selecting a tub drying step; sensing door operation of the laundry machine; and performing the tub drying step based on the result of the door operation. Further, a laundry machine is disclosed that comprises a tub drying step selecting part configured to dry a tub (2); and a control part configured to control the tub (2) dried in case the tub drying step selecting part is selected.

13 Claims, 5 Drawing Sheets

(56) References Cited

U.S. PATENT DOCUMENTS

| | | | | |
|---|---|---|---|---|
| 2,577,104 | A * | 12/1951 | Butler | 34/572 |
| 4,623,179 | A * | 11/1986 | Davis et al. | 292/201 |
| 5,782,012 | A * | 7/1998 | Sanders et al. | 34/527 |
| 5,852,881 | A * | 12/1998 | Kuroda et al. | 34/527 |
| 5,953,831 | A * | 9/1999 | Yu | 34/269 |
| 7,117,613 | B2 * | 10/2006 | Guinibert et al. | 34/534 |
| 7,146,749 | B2 * | 12/2006 | Barron et al. | 34/596 |
| 7,475,571 | B2 * | 1/2009 | Koo et al. | 68/3 R |
| 2004/0144138 | A1 * | 7/2004 | Takeuchi et al. | 68/24 |
| 2004/0226187 | A1 * | 11/2004 | Bruntz et al. | 34/527 |
| 2007/0130700 | A1 | 6/2007 | Cho et al. | |
| 2007/0209411 | A1 * | 9/2007 | Lim et al. | 70/263 |
| 2010/0229418 | A1 * | 9/2010 | Lee | 34/427 |
| 2011/0016641 | A1 * | 1/2011 | Koo et al. | 8/137 |
| 2011/0113569 | A1 * | 5/2011 | Ashrafzadeh et al. | 8/159 |
| 2012/0066928 | A1 * | 3/2012 | Son et al. | 34/427 |
| 2012/0330442 | A1 * | 12/2012 | Hwang et al. | 700/90 |
| 2013/0104608 | A1 * | 5/2013 | Park et al. | 68/5 C |
| 2013/0115130 | A1 * | 5/2013 | Kappler | 422/5 |
| 2013/0119129 | A1 * | 5/2013 | Amdahl et al. | 235/381 |
| 2013/0174353 | A1 * | 7/2013 | Ashrafzadeh et al. | 8/137 |

FOREIGN PATENT DOCUMENTS

| | | | |
|---|---|---|---|
| KR | 20-0124266 | Y1 | 6/1998 |
| KR | 10-2006-0004496 | A | 1/2006 |
| KR | 10-0692619 | B1 | 3/2007 |

* cited by examiner

LAUNDRY MACHINE AND CONTROLLING METHODS THEREOF

TECHNICAL FIELD

The present invention relates to a laundry machine and a controlling method thereof.

BACKGROUND ART

Generally, laundry machines include at least one of washing, rinsing, dry-spinning and drying cycles to wash washing clothes, cloth items, beddings, shoes and the like (hereinafter, laundry). Such a laundry machine includes a tub configured to hold water therein and a rotatable drum provided in the tub. Here, the tub is provided in the laundry machine and it holds water therein. Because of that, the tub is never dry completely and foreign substances such as detergent happen to remain between the drum and the tub after washing.

DISCLOSURE OF INVENTION

Technical Problem

An object of the present invention is to provide a laundry machine capable of drying an inside of a tub and a controlling method thereof.

Another object of the present invention is to provide a laundry machine capable of performing a cleaning process in a predetermined space between a tub and a drum, and a controlling method thereof.

Solution to Problem

To achieve these objects and other advantages and in accordance with the purpose of the invention, as embodied and broadly described herein, a controlling method of a laundry machine comprising a tub and a drum, the controlling method includes steps of: sensing selection of a tub drying course; and performing the tub drying course.

In another aspect of the present invention, a controlling method of a laundry machine includes steps of: selecting a tub drying course; sensing door operation of the laundry machine; and performing the tub drying course based on the result of the door operation.

In a further aspect of the present invention, a laundry machine includes a tub drying course selecting part configured to dry a tub; and a control part configured to control the tub dried in case the tub drying course selecting part is selected.

Advantageous Effects of Invention

The present invention has following advantageous effects.

First of all, according to the controlling method of the present invention, the inside of the tub may be dried without using any auxiliary device.

Furthermore, according to the controlling method, a predetermined space formed between the drum and the tub may be washed to remove foreign substances.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Figure 1:
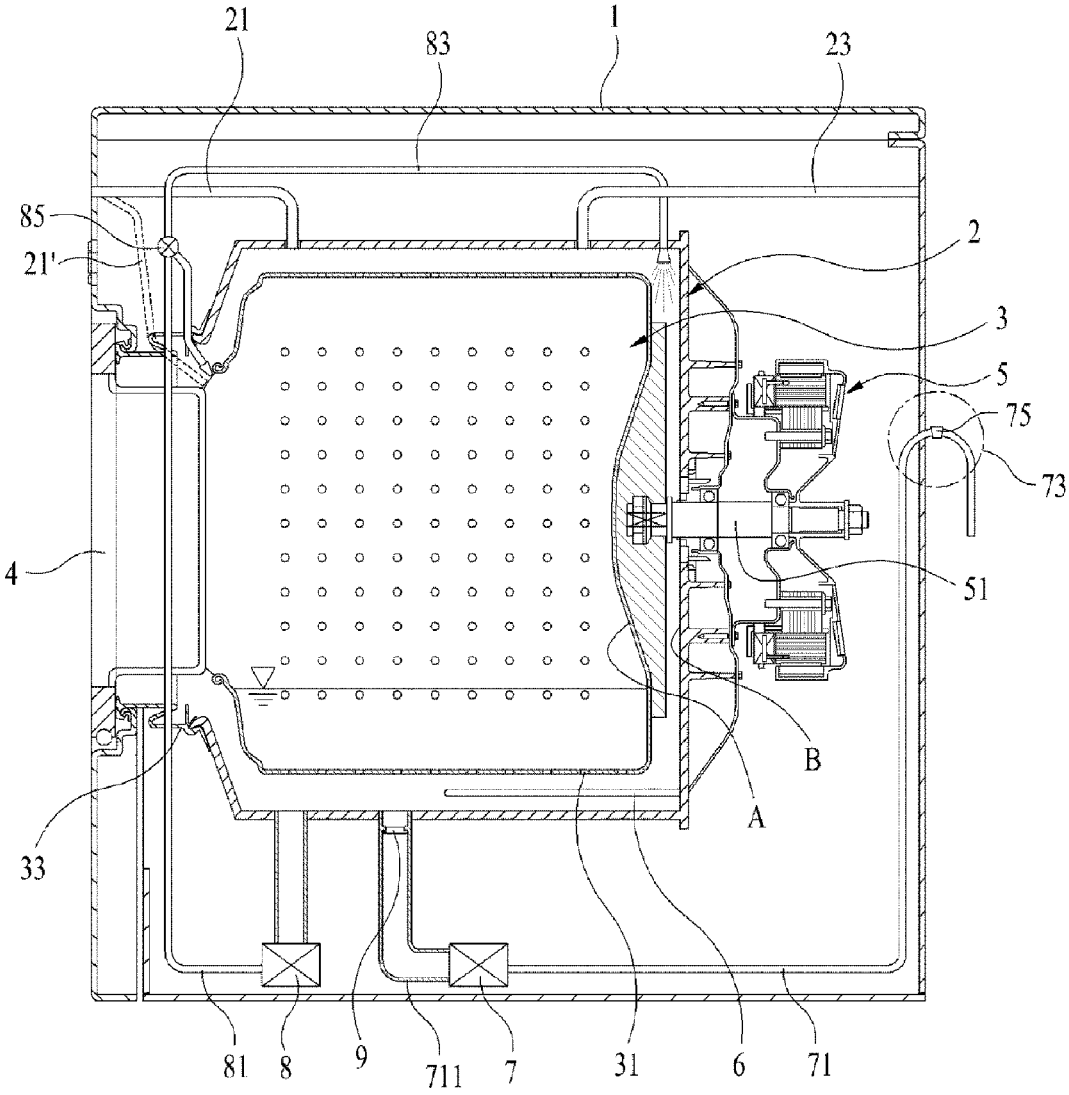
FIG. 1 is a side view illustrating an inner configuration of a laundry machine according to an exemplary embodiment of the present invention.

Reference will now be made in detail to the specific embodiments of the present invention, examples of which are illustrated in the accompanying drawings. Wherever possible, the same reference numbers will be used throughout the drawings to refer to the same or like parts.

First of all, in reference to FIG. 1, a configuration of a laundry machine to which a controlling method according to embodiments of the present invention will be applied will be described.

The laundry machine may include a cabinet 1 configured to define an exterior appearance thereof, a tub 2 provided in the cabinet 1 to hold wash water therein and a drum 3 rotatably provided in the tub 2. furthermore, the laundry machine may include a drainage pump 7 configured to drain the water held in the tub 2 and a circulation pump 8 configured to circulate the wash water held in the tub 2.

The cabinet 1 may include an opening (not shown) formed in a front surface thereof and a door 4 coupled to the front surface, adjacent to the opening. The door 4 may open and close the opening of the cabinet 1 via a predetermined configuration such as a hinge (not shown), such that laundry may be loaded into and unloaded from the drum 3.

The tub 2 may be in communication with a water supply pipe (not shown) and a detergent supply part (not shown) which may be provided in the cabinet 1. In this case, the detergent supply part may be provided in a middle portion of the water supply pipe to supply detergent selectively when water is supplied.

The drum 3 may be rotatable in the tub 2 and it may include a predetermined space to accommodate laundry. The drum 3 may receive a rotational force generated by a motor 5 and the motor 5 may be provided in a rear surface of the tub 2. A shaft 51 provided in the motor 5 may be connected with the drum 3, passing through the rear surface of the tub 2, to rotate the drum 3. Here, the drum 3 may include a plurality of through-holes 31 and the through-holes 31 may be provided in an outer circumferential surface of the drum 3, to draw the water held in the tub into the drum or to discharge the water held in the drum 3 to the tub 2.

In the meanwhile, the tub 2 and the cabinet 1 may be connected with each other by a sealing part 33. Because of the sealing part 33, the water held in the tub 2 may be prevented from leaking into the cabinet 1.

Also, a heater 6 may be provided in the tub 2, more specifically, in a predetermined space between the tub 2 and the drum 3. The heater 6 heats water to be supplied to the tub 2 and the tub 2 may have the water with a predetermined temperature. The heater 6 of the laundry machine according to embodiments of the present invention may be drivable to dry an inside of the tub 2. That is, a heater provided in a conventional laundry machine is used only to heat wash water. However, the heater 6 according to the embodiments of the present invention may be driven to dry the inside of the tub based on control of a control part (not shown). That is, the control part (not shown) of the laundry machine drives the heater 6 to heat internal air of the tub 2.

To enable the heater 6 to dry the inside of the tub 2 efficiently, the laundry machine may include at least one air path configured to communicate the inside of the tub 2 with an outside of the laundry machine. According to the conventional laundry machine, laundry having washed completely is taken out of a drum and a door is closed. At this time, it is difficult for air inside the tub and the drum to communicate with each other. If the heater is driven in this state of no air communication between the inside the tub and the outside, the temperature inside the tub happens to be increased too high to damage the inner configuration of the laundry machine. Because of that, the laundry machine according to the embodiments of the present invention may include the air path to allow the air inside the tub 2 to communicate with external air even in the state of the door 4 being closed.

The air path mentioned above may include at least one of first and second air paths 21 and 23. The first air path 21 is provided in a front portion of the tub 2 to draw air into the tub 2 and the second air path is provided in a rear portion of the tub 2 to discharge internal air of the tub 2 outside.

The first air path 21 may be connected with the cabinet 1 directly or it may be connected with devices configured to draw external air of the cabinet 1 therein, such as the detergent supply part. For example, the detergent supply part (not shown) may be a drawer type provided in a front plate of the cabinet 1 or a door type provided in a top plate of the cabinet. In any case of the two, the detergent supply part is not a closed structure with respect to the outside of the cabinet 1. Only if an end of the first air path 21 is connected with the detergent supply part, external air of the cabinet 1 may be drawn into the tub 2 via the first air path 21.

The second air path 23 may be connected with the tub and the other end may be connected with a rear plate of the cabinet 1.

The laundry machine including the air path mentioned above may supply external air to the laundry provided in the tub 2, even with maintaining the closed state of the tub 2 by the door 4 for a relatively long time. After the laundry is unloaded, the inside of the tub 2 may be dried by the operation of the heater efficiently and the laundry machine may be managed more hygienically.

A numeral reference of 21' presented by dotted lines shown in FIG. 1 is an air path according to another embodiment. A third air path 21' according to this embodiment includes an end in communication with an outside of the laundry machine and the other end connected with an inside of the drum 3, such that external air of the cabinet may be directly drawn into the drum 3. In this case, the external air of the cabinet 1 is directly drawn into the drum 3 via the first air path 21' and after that, the air may be supplied to an inner circumferential surface of the tub 2 via the through holes 31. This is more effective in drying the drum 3.

In the meanwhile, the control part (not shown) turns on the heater 6 for a predetermined time period and it turns off the heater for a predetermined time period, to dry the inside of the tub 2. In case the control part (not shown) drives the heater 6 continuously, the temperature of the internal air of the tub 2 will increase drastically enough to deform the inner configuration of the laundry machine. To prevent this, the control part (not shown) performs the on-off control with respect to the heater 6. For example, a temperature sensor may be provided in the tub 2 or drum 3 and the sensor measures the temperature of the internal air thereof, before the control part controls the heater 6. When the temperature measured by the temperature sensor reaches a preset maximum value, the control part turns off the heater. When the temperature measured by the temperature sensor reaches a preset minimum value, the control par re-turns on the heater. Here, the control part presets a target temperature of the tub inside and it performs closed-loop-control for the measured value of the temperature sensor to maintain the target temperature.

Also, the control part may rotate the drum 3 during the operation of the heater 6. When the heater 6 is put into operation, air of a lower surface of the tub, which is close to the heater 6, will be heated first. When the drum 3 is rotated to mix the internal air of the tub, the inside of the tub 2 may be dried quickly and uniformly.

In the meanwhile, the drainage pump 7 may be provided in the cabinet 1 to drain the water held in the tub 2. An end of the drainage pump 7 may be in communication with a tub connection pipe 711 connected with a lower surface of the tub 2 and the other end of the drainage pump 7 may be in communication with a drainage path 71 in communication with the outside of the cabinet 1.

The drainage path 71 may be provided along a lower plate of the cabinet 1 and it may include a bent part 73 bend downward from a predetermined portion distant a predetermined height from the lower plate of the cabinet 1. A siphon preventing part 75 may be provided in the bent part 73 and both of the bent part and siphon preventing part 73 and 75 prevent all of the water held in the tub 2 from draining because of a siphon phenomenon, when the drainage pump 7 is stopped during the water drainage. The siphon preventing part 75 is provided in the bent part 73 to draw air into the drainage path 71 and it is well-known to those skilled in the art. Because of that, the detailed description of the siphon preventing part 75 will be omitted.

In case of the dry-spinning cycle configured to remove wash water from the laundry, the water removed from the laundry may be drained via the drainage pump 7 during the rotation of the drum 3. However, when the operation of the drainage pump 7 is stopped, the water located between the bent part 73 and the drainage pump 7 might flow backward into the tub 2 along the drainage path 71. As a result, the laundry machine may further include a check valve 9 provided along the drainage path 71 to prevent the water from flow backward into the tub 2.

As follows, the structure and usage of the check valve 9 will be described in reference to FIGS. 2 and 3.

Figure 2:
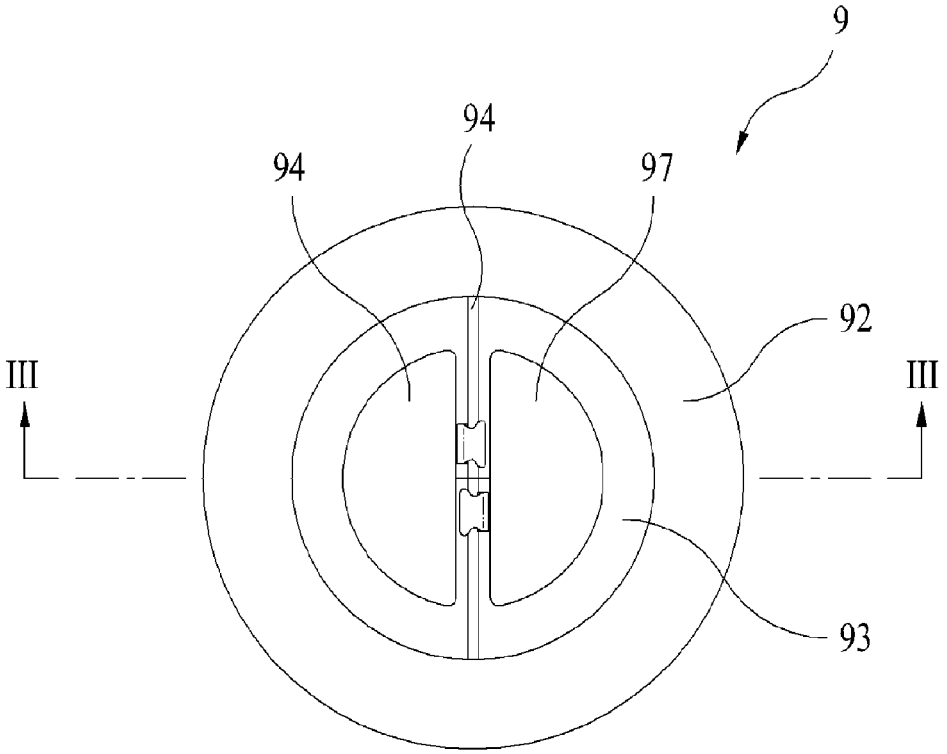
FIG. 2 is a plane view illustrating a check valve according to an embodiment of the present invention.
Figure 3:
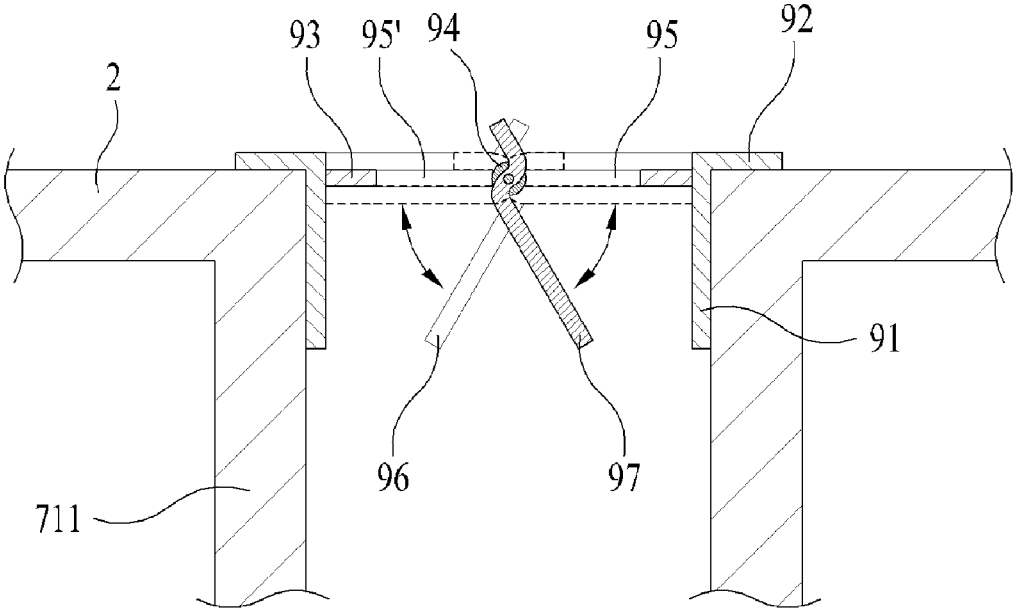
FIG. 3 is a side sectional view of FIG. 2.

In reference to FIGS. 2 and 3, the check valve 9 may be provided in a connecting portion between the tub 2 and the tub connection pipe 711. for example, the check valve 9 includes a cylindrical body 91 inserted in the tub connection pipe 711, a protrusion 93 projected from an inner circumferential surface of the body, a hinge fixer 94 crossing the inner circumferential surface of the body 91, and a plate rotatably provided in the hinge fixer 94 to open and close a path 95.

The body 91 may be cylindrical-shaped and it may include a securing projection 92 configured to allow the body 91 supported to the lower surface of the tub 2. The protrusion 93 may be provided along the inner circumferential surface of the body 91 and it may limit the rotation of the plate toward the tub 2.

The plate may include first and second plates 96 and 97 rotatably provided in the hinge fixer 94. The first plate 96 is hingedly connected with the hinge fixer 94 and it opens and closes a left path 95' of the hinge fixer as shown in the drawings. The second plate 97 is hingedly connected with the hinge fixer 94 and it opens and closes a right side path 95 of the hinge fixer 94 as shown in the drawings. As a result, when the water does not flow backward to the tub connection pipe 711, the first and second plates 96 and d97 open the paths 95 and 95' because of their weights. In contrast, when the water flows backward along the tub connection pipe 711 toward the tub inside, the first and second plates 96 and 97 rotate upward as shown in the drawings via the hinge fixer 94. In this case, the first and second plates 96 and 97 close the paths 95 and 95', with being supported by the protrusion 93, such that the backflow of wash water may be prevented.

Figure 4:
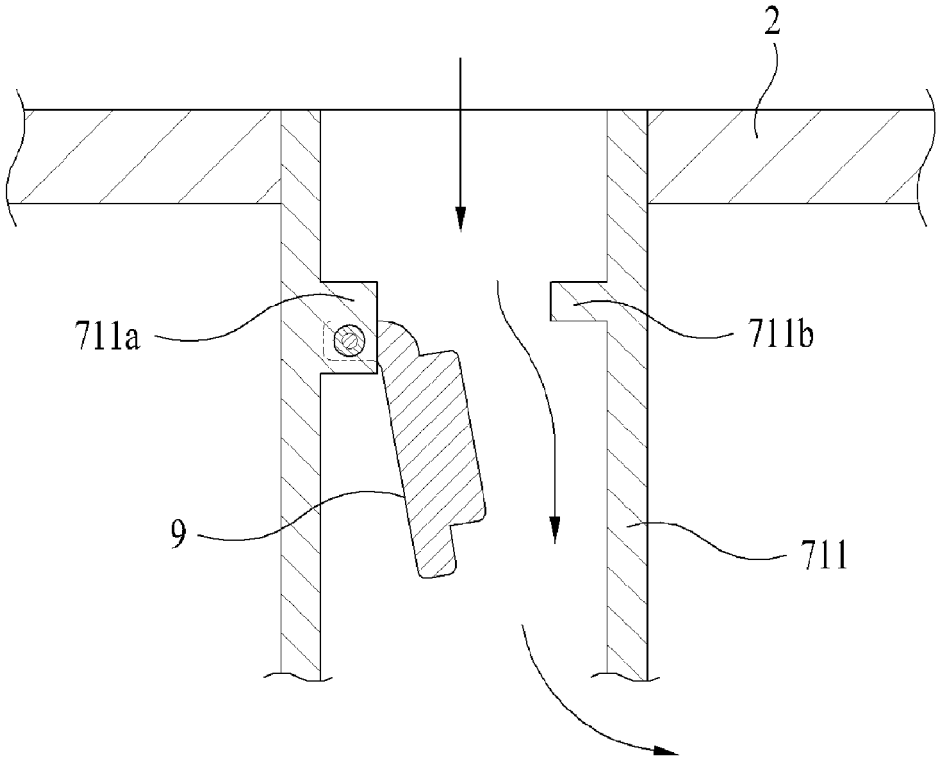
FIG. 4 is a side sectional view illustrating a check valve according to another embodiment which is in an open state.
Figure 5:
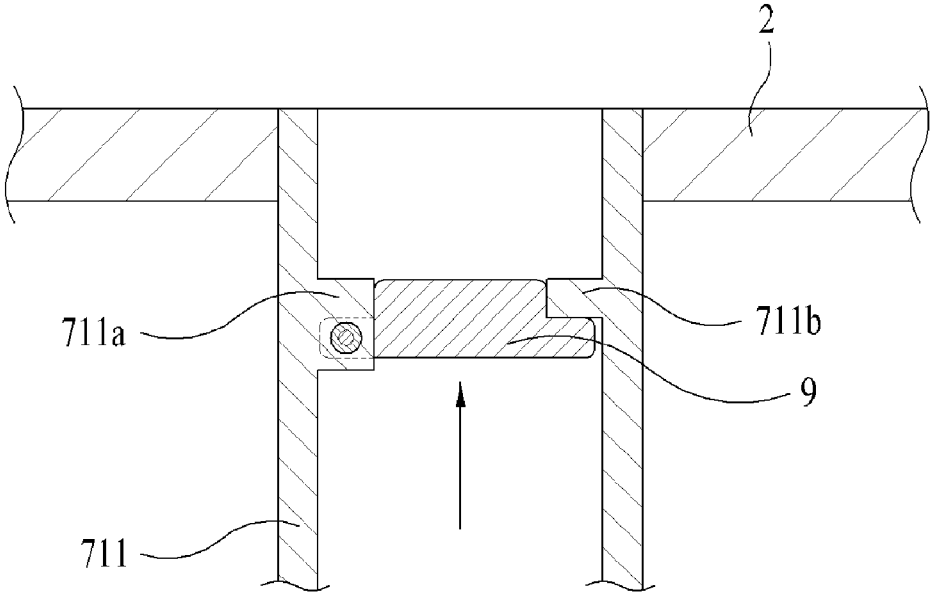
FIG. 5 is a side sectional view illustrating the check valve of FIG. 4 which is a closed state.

FIGS. 4 and 5 show the check valve 9 according to different embodiments, respectively. The check valve 9 according to this embodiment may be provided along the tub connection pipe 711 of the drainage path 71, which is located between the tub 2 and the drainage pump 7.

The tub connection pipe 711 may include a securing part 711*a* configured to support the check valve 9 and a securing projection 711*b* configured to support an outer circumferential surface of the check valve. In this case, the check valve 9 may be made of elastic material such as rubber to be secured to the securing part 711*a*. As a result, when the water is held in the tub or while the drainage pump is operated, the tub connection pipe 711 may be opened as shown in FIG. 4. In case the water flows backward along the tub connection pipe, the tub connection pipe 711 may be closed as shown in FIG. 5.

In reference to FIG. 1 again, the circulation pump 8 may be provided in the cabinet 1 to circulate the water held in the tub 2 into the tub 2 and the drum 3. A predetermined end of the circulation pump 8 may be in communication with the lower surface of the tub 2 and the other end may be connected with a circulation path 81. An end of the circulation path 81 is connected with the circulation pump 8 and the other end of the circulation path 81 is connected with a front surface of the drum 3. Both of the circulation pump 8 and the circulation path 81 are configured to spray the water held in the tub 2 toward the laundry via the circulation path 81, to improve washing efficiency and rinsing efficiency.

In the meanwhile, the laundry machine having the configuration described above may have bubbles generated in the tub 2 during the washing to remain on an outer rear surface (A) of the drum 3 and an inner rear surface (B) of the tub 2. That is, the water is supplied to the tub 2 up to a predetermined height from the lower surface of the tub 2. Because of that, bubbles or foreign substances will contact with a predetermined portion of the inner rear surface (B) of the tub during the washing or rinsing cycle. If then, it is impossible to remove the bubbles or foreign substances. The drum 3 may have less bubbles or foreign substances because it has a friction with the water during the rotation. However, a predetermined portion of the drum 3 adjacent to the shaft 51 cannot have the friction with the water and this portion will have remaining bubbles or foreign substances.

As a result, the laundry machine according to the embodiment of the present invention may include a spraying path 83 configured to spray water to a predetermined space formed between the outer rear surface (A) of the drum 3 and the inner rear surface (B) of the tub 2. As shown in FIG. 1, the spraying path 83 may be branched from the circulation path 81 or it may be connected with an auxiliary pump (not shown) without being branched from the circulation path 81. Here, if the circulation path 83 is branched from the circulation path 81 as shown in FIG. 1, the single circulation pump 8 may be used to perform the circulation of wash water and cleaning of the tub rear surface simultaneously and production cost may be reduced advantageously. If the spraying path 83 is branched, a change-over valve may be provided in a branched portion. Because of that, only the circulation path 81 is open to supply the water supplied by the circulation pump 8 to a front portion of the tub. Only the spraying path 83 is opened to supply the water only to a rear portion of the tub 2. Both of the circulation path 81 and the spraying path 83 are opened to supply the water to the front and rear portions of the tub.

Here, the control part drives the circulation pump 8 and it controls the three-way valve, to spray at least predetermined amount of the water held in the tub 2 into the space between the outer rear surface (A) of the drum 3 and the inner rear surface (B) of the tub 2. at this time, since the space formed between the outer rear surface (A) of the drum 3 and the inner rear surface (B) of the tub 2 is very narrow, the water supplied via the spraying path 83 can remove the bubbles or foreign substances stuck to the surfaces and the problem of the remaining bubbles or foreign substances in the outer rear surface of the drum 3 and the inner rear surface of the tub 2 may be solved.

The laundry machine according to the present invention may include the spraying path 83 branched from the circulation path 81 simply, without the change-over valve. In this case, when the circulation pump 8 is put into operation, a predetermined amount of the circulating water may move along the circulation path 81 and the other may move along the spraying path 83.

Figure 6:
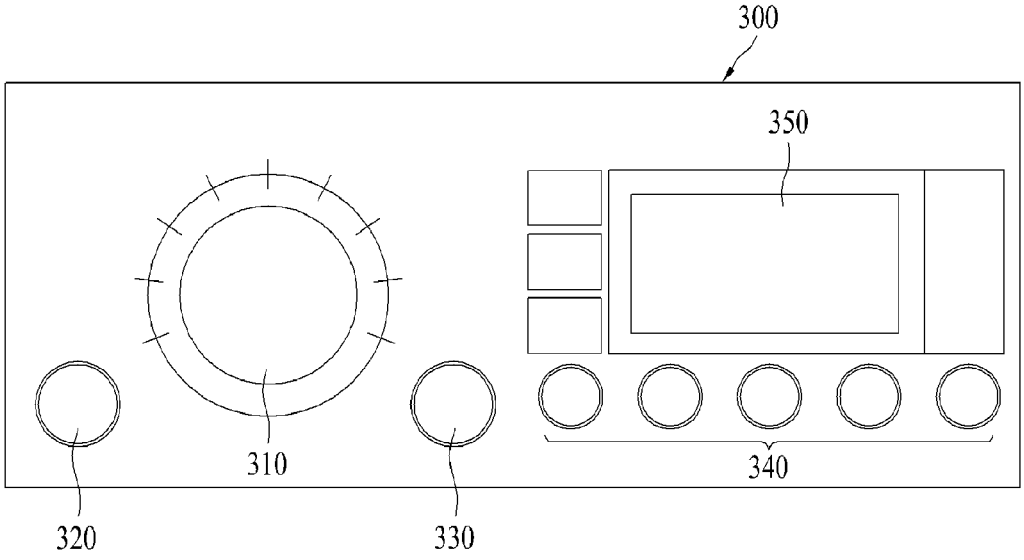
FIG. 6 is a front view illustrating a control panel provided in the laundry machine of FIG. 1.

FIG. 6 is a front view illustrating a control panel provided in a predetermined portion of the laundry machine shown in FIG. 1.

In reference to FIG. 6, the control panel 300 includes a course selecting part 310 configured to allow a user to select a variety of courses and an option selecting part 340 configured to allow the user to select conditions of at least one of washing, rinsing, dry-spinning and drying cycles provided in the selected course.

Here, terminology of 'course' means a process having a series of cycles put into to operation and completed automatically. For example, in a standard course of washing courses, the laundry machine performs the washing, rinsing, dry-spinning and drying cycles and it automatically finishes it operation after the cycles. Here, only when the user selects each of the courses, the laundry machine may be operates according to the pre-programmed cycles, except special cases. Specific conditions for each course may be variable. For example, a total course performing time, a rotation speed of the drum, combination of the sub-cycles may be variable according to preset programs. Each course may be selectable by the user based on the kind and the quantity of laundry and it may include at least one of the washing, rinsing, dry-spinning and drying cycles.

The course selecting part 310 may be configured of a dial-knob, for example, and the user may rotate the dial-knob to select a desired course. Although not shown in the drawings, the course selecting part may be configured of a button type. Such the courses may be variable according to the kind of laundry, a contamination degree of laundry and a special purpose of washing.

Such the course may include sub-cycles. That is, the course may include the washing cycle configured to wash laundry by using both of water and detergent and the rinsing cycle configured to rinse the washed laundry by using water. Moreover, the course may include the dry-spinning cycle configured to spin the laundry to remove water elements and the drying cycle configured to dry laundry by using dried air supplied to the drum.

The user may select a desired course via the course selecting part 310.

The course selecting part 310 of the control panel 300 may further include an auxiliary tub drying course. As shown in FIG. 6, the user may select the tub drying course via the course selecting part 310. Here, the course selecting part 310 may function as the tub drying course selection part. Once the user selects the tub drying course, the control part performs the tub drying course according to a preset programmed stored therein and this tub drying course will be described later.

If the user cannot select another course, for example, the standard course in case of selecting the tub drying course, the user may feel inconvenient. When he or she wishes to dry the tub after driving the laundry machine according to the standard course, the user has to select the standard course and to select the tub drying course again after waiting until the standard course finishes.

To prevent that inconvenience, according to another embodiment of the present invention, the tub drying course and another course, for example, the standard course may be selected together from the course selecting part 310. For example, when the user selects the tub drying course from the course selecting part 310, the other courses may be still in a selectable state. In contrast, when the user selects the standard course or the like from the course selecting part 310, the tub drying course may be still in a selectable state. Here, it may be preset in various ways to notify the user of whether the courses of the course selecting part 310 are in the selectable state. For example, corresponding courses are luminescent or off to show them in the selectable state. As a result, the user may select another course from the course selecting part together with the tub drying course.

In the meanwhile, the tub drying course may not be selectable together with another course. That is, when the user selects a predetermined course from the course selecting part 310, the tub drying course may not be in the selectable state for the user not to select. Also, when the user selects the tub drying course, the other courses may not be in the selectable state. In this case, if he or she wishes to dry the tub after driving the laundry machine according to a selected standard course, the user has to select the tub drying course again after the standard course inconveniently.

In the meanwhile, the course selection part 310 may be further provided with a tub washing course. In this case, the tub washing course may be provided in the course selection part 310 separately from the tub drying course, or the tub washing course may be provided in the course selection part 310 together with the tub drying course. Therefore, the user may select only the tub washing step or the tub drying step or both of them.

In case the course selecting part is configured of a button type, the course selecting process may be performed more smoothly. That is, even when the user pushes a button of a desired course, another buttons of the tub washing step or the tub drying step may be still in the selectable state. As a result, when the user selects the tub washing step or/and the tub drying step after selecting the desired course, the selected course is performed and the tub washing step or/and the tub drying step is performed after that. In contrast, when the user pushes the button of the tub washing step or/and the tub drying step first, the other buttons of the other courses may be still in the selectable state. When the user selects another desired course, the selected washing course may be performed and the tub washing step or/and the tub drying step may be performed after that.

The tub washing step or/and the tub drying step may be selectable while the selected course is performed. That is, even if the user operates the course selecting part 310 during the operation of the laundry machine, the tub washing step or/and the tub drying step may be in the selectable state and the user may select the tub washing step or/and the tub drying step from the course selecting part 310. Then, the tub washing step or/and the tub drying step may be performed after the selected course finishes.

In the meanwhile, the control panel may include a plurality of option selecting parts 340. Here, the option selecting parts 340 may be configured to select options including washing, rinsing, dry-spinning and a water temperature, drying and the like.

For example, the washing option may be configured to allow the user to select various conditions, for example, the number of washing cycles and the time of the washing cycle which compose the selected course. The rinsing option may be configured to allow the user to select various conditions, for example, the number of the rinsing cycles and the time of the rinsing cycle. Alternatively, the washing option may be configured to allow the user to select to perform only the washing cycle, independent from the course selecting part 310 and the rinsing option may be configured to allow the user to select to perform only the rinsing cycle, independent from the course selecting part 310. that is, the option selecting parts 340 may be configured to allow the user to change conditions (for example, water temperature) of the selected course or conditions (for example, the number of washing cycles) of the cycles composing the selected course, or they may be configured to allow the user select to perform only the desired cycle, together with the above function or independent from the above function. In case of the latter, the option selecting part 340 may be referenced to as cycle selecting part.

For example, when he or she desires to perform only the rinsing of the laundry simply, the user may select to perform only the rinsing cycle from the rinsing option. Because of that, the option selecting part 340 does not always have assumption of course selecting via the course selecting part 310. That is, the option selecting part 340 allowing the user to select only a specific cycle composing the course may be selected.

In the meanwhile, the control panel 300 may have the course selecting part 310 to include the tub washing step or/and the tub drying step. As a result, the option selecting part 340 may include a tub washing step or/and a tub drying step option selection part configured to allow the user to select various conditions of the tub washing step or/and the tub drying step. Here, the tub washing step enables water to be supplied to the tub 2 and the drum 3 rotated at a predetermined speed to wash the tub 2. the tub drying step enables the inside of the drum 3 to be dried by operating the heater provided in the tub 2 and it enables the drum 3 to be rotated. Therefore, via the tub washing step or/and the tub drying step option selection part the user may adjust the amount of the water required by the tub washing step and the rotation speed of the drum 3 for the tub washing step, or the driving temperature of the heater and the rotation speed of the drum for the tub drying step.

As mentioned above, in case the tub washing step or/and the tub drying step is selected from the course selecting part 310 or the options of the tub washing step or/and the tub drying step are selected from the option selecting part 340, the user may be notified of the selection via display of this process by using a LCD window 350 to prevent the user's selecting operation error. When the tub washing step or/and the tub drying step is selected, the LCD window 350 displays to the user that the tub washing step or/and the tub drying step is selected.

As follows, a controlling method of the laundry machine having the above configuration will be described. First of all, a controlling method of the laundry machine according to the embodiment in case only the tub washing step or the tub drying step is selected from the course selecting part (including the embodiment in that another course is not selectable) will be described. After that, a controlling method of the laundry machine according to the embodiment in case another course, for example, the standard course is selectable together with the tub washing step or the tub drying step will be described later.

The user operates the course selecting part 310 and he or she selects the tub washing step or the tub drying step, and the control part of the laundry machine senses whether the tub washing step or the tub drying step is selected.

First of all, the tub washing step may include supplying wash water to the tub 2 up to a predetermined water level and washing the tub 2 by rotating the drum at a predetermined speed.

The control part may control the predetermined water level of the water supplied to the tub 2. Here, when supplying the water, only the water may be supplied not together with detergent. If detergent is supplied together with the water, the detergent might remain between the tub 2 and the drum 3 and this would deteriorate cleanliness of the tub 2. The amount of the supplied water may be preset according to the capacity of the tub 2 and/or the drum 3 and stored in the control part. As a result, the control part may supply the preset amount of the water to the tub 2.

After supplying the water to the tub, the control part controls the heater 6 to heat the water. That is, the higher the temperature of the water is, the more efficient the washing of the tub is. For example, the high temperature water may soak dirt and foreign substances of the tub 2 and remove them efficiently.

Hence, the control part rotates the drum 3 at a predetermined speed to perform the washing of the tub inside. Once the drum 3 is rotated at the predetermined speed or higher, the water held between the drum 3 and the tub may be rotated together with the drum, such that the inner surface of the tub 2 and the outer surface of the drum 3 may be washed.

In the meanwhile, when rotating the drum 3, the control part drives the circulation pump 8 to circulate the water and cleaning efficiency may be improved. At this time, the control part controls at least predetermined amount of the circulating water to be supplied to the space between the outer rear surface (A) of the drum 3 and the inner rear surface (B) of the tub 2. that is, the control part controls the change-over valve 85 to supply all of the water or at least predetermined amount of the water to the space between the outer rear surface (A) of the drum and the inner rear surface (B) of the tub 2 via the circulation path 81.

Once the tub washing step finishes, the control part may start the tub drying step (S350). As mentioned above, if only the tub drying step is selected, the tub drying step may be performed with omitting the tub washing step. Here, the tub drying step (S350) may include driving the heater and rotating the drum.

In the heater driving step, the control part drives the heater 6 to heat internal air of the tub 2. Especially, in the heater driving step, the control part (not shown) on-off-controls the heater 6 to prevent damage and deformity of the inner parts which might be generated by overheating the internal air of the tub 2. For example, the control part turns on the heater and turns off in a predetermined time. This on-off control is repeated and the drying of the tub inside may be performed. Alternatively, the temperature sensor may be provided in the tub 2 or the drum 3 and it measures the temperature of the internal air to control the heater 6. As a result, the control part turns off the heater, in case the temperature measured by the temperature sensor reaches a preset maximum value, and it turns on the heater again, in case the temperature measured by the temperature sensor reaches a preset minimum value. In another case, the control part presets a target temperature of the tub inside and it performs closed loop control for the temperature measured by the temperature sensor to maintain the target temperature. At this time, it may be determined by an auxiliary sensor (humidity sensor) configured to sense dryness of the tub inside or based on the driving time of the heater preset by experiments whether the tub 2 is completely dried.

Here, the control part may rotate the drum 3 while the heater driving step is performed.

When the heater 6 is driven, air located near the lower surface of the tub close to the heater may be heated firstly. Because of that, the drum 3 is rotated while the driving of the heater 6 to accelerate heating of the air inside the tub 2. That is, the rotation of the drum 3 diffuses the air heated by the heater to dry the inside of the tub 2 and the inside of the drum 3.

Especially, the tub includes at least one of the first and second air paths 21 and 23 configured to draw external air into the tub 2 and to discharge internal air outside the tub 2, respectively. Because of that, the drying process of the tub 2 and the drum 3 may be performed efficiently. Also, after the air drawn into the first air path 21' is drawn into the drum 3, the air may pass the through holes 31 and it may be discharged via the second air path 23. In this case, the drying of the drum 3 may be performed more efficiently.

Figure 7:
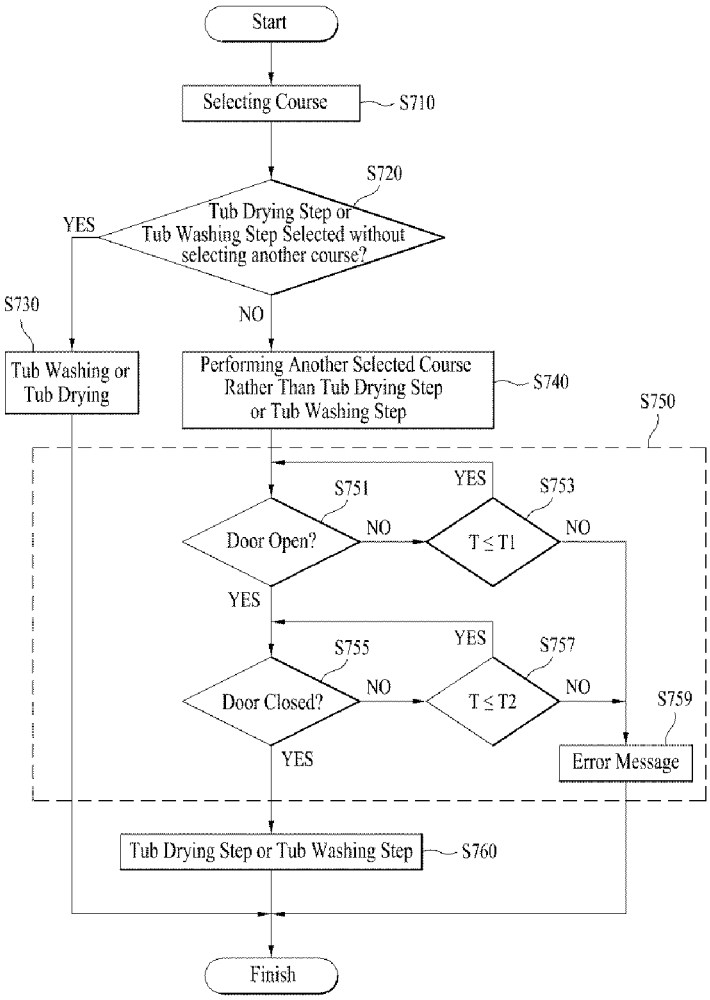
FIG. 7 is a flow chart illustrating a controlling method according to an embodiment of the present invention.

In case a predetermined course for washing is selected together with the tub washing step or the tub drying step, the selected course is complete and after that, the tub washing step or the tub drying step mentioned above is performed. FIG. 7 is a flow chart illustrating a controlling method of the embodiment configured to allow the tub washing step/the tub drying step and another course to be selected together.

In reference to FIG. 7, the user operates the course selecting part 310 and he or she selects a desired course (S710).

Hence, when the user selects the course, the control part determines whether the tub washing step or the tub drying step is selected alone or together with another course (S720).

Here, when the user selects the tub washing step or the tub drying step alone, that is, only the tub washing step or the tub drying step without selecting another course (for example, standard course), the tub washing step or the tub drying step may be performed. Like in the above embodiment, the tub washing step and the tub drying step are performed (S730). the tub washing step or the tub drying step is described in the above embodiment and it will be omitted accordingly.

When the user selects another course together with the tub washing step or the tub drying step, the control part performs another selected course prior to the tub washing step or the tub drying step (S740).

Hence, the control part may further include sensing whether the door is operated before performing the tub washing step or the tub drying step after the selected course (S750). This is because it has to be sensed whether the user opens the door 4 to unload the laundry and closes the door again, after the selected course is complete. That is, if the tub washing step or the tub drying step is performed in a state of the laundry loaded in the drum, wash water will be re-supplied to the laundry having had the dry-spinning cycle and time as well as water waste will occur.

As a result, if it is sensed that the user will not open after the selected course finishes, the laundry may be believed to be still in the drum 3. The control part senses whether the door 4 is open or not (S751). The control part senses whether the door 4 is open for a preset time period (T1)(S753). If the door 4 is sensed not to be open within the preset time period based on the result of the sensing, the control part generates an error signal (error message) (S759) and it is notified to the user that the laundry is not unloaded, and then the control part completes the operation of the laundry machine.

In the meanwhile, if the door is not open after the selected course, the control part may further include notifying the closed state of the door 4 to the user. That is, the user is notified that the laundry is not unloaded. This notification may be performed visually by using the LCD window 350 of the control panel 300 or auditorily by using a speaker.

Even when the user does not close the door after opening the door and unloading the laundry after the selected course, the control part may not perform the tub washing step or the tub drying step. This is because the door 4 is open. Specifically, the control part senses whether the door 4 is closed (S755) after the door 4 is open. When it is sensed for a predetermined time period (T2) whether the door 4 is closed (S757) and the user closes the door 4, the control part may perform the tub washing step or the tub drying step (S760). In case the user does not close the door 4 for the predetermined time period (T2), the control part generates an error signal (S759) and it stops the operation of the laundry machine.

In case the user does not close the door 4, the control part may notify the user that the door is not closed via the control panel 300. It may be sensed by a sensor provided in the door 4 whether the door 4 is open or closed and the sensor may transmit a door open signal or door closed signal to the control part.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A controlling method of a laundry machine including a tub and a heater provided in the tub, comprising steps of:

selecting a tub drying step that dries an inside of the tub by an operation of the heater after a laundry is unloaded;

sensing door operation of the laundry machine; and performing the tub drying step based on the result of the door operation.

2. The controlling method as claimed in claim 1, wherein the step of performing the tub drying step based on the result of the door operation performs the tub drying step, in case opening and closing of the door is sensed in the step of sensing the door operation.

3. The controlling method as claimed in claim 1, wherein an error signal is generated and the operation of the laundry machine is finished, in case the step of sensing the door operation does not sense the opening of the door in a predetermined time period.

4. The controlling method as claimed in claim 3, further comprising a step of notifying a user that laundry is not unloaded, in case the opening of the door is not sensed.

5. The controlling method as claimed in claim 1, wherein the tub drying step is performed, in case the opening of the door is sensed in a predetermined time period.

6. The controlling method as claimed in claim 2, wherein an error signal is generated and the operation of the laundry machine is finished, in case the step of sensing the door operation does not sense the closing of the door in the predetermined time period after the door is open.

7. The controlling method as claimed in claim 6, further comprising a step of notifying a user that the door is not closed, in case the closing of the door is not sensed.

8. The controlling method as claimed in claim 6, wherein the tub drying step is performed in case the closing of the door is sensed in a predetermined time period.

9. The controlling method as claimed in claim 1, wherein the tub drying step is selectable together with a predetermined washing course of the laundry machine.

10. The controlling method as claimed in claim 9, wherein the tub drying step is selectable before the predetermined washing courses is selected or while the laundry machine is operated according to the predetermined washing course.

11. The controlling method as claimed in claim 9, wherein the tub drying step is performed after the selected course is complete, in case the tub drying step is selected together with the predetermined course.

12. The controlling method as claimed in claim 1, wherein the tub drying step comprises:

driving the heater provided in the tub to dry the inside of the tub; and rotating the drum provided in the tub.

13. The controlling method as claimed in claim 12, wherein the heater driving step comprises a step of turning on-off the heater at a predetermined interval.

* * * * *